US009856003B2

(12) United States Patent
Stein et al.

(10) Patent No.: US 9,856,003 B2
(45) Date of Patent: Jan. 2, 2018

(54) SAIL MEMBRANE

(75) Inventors: Uwe Stein, Heinsberg (DE); Heiner Schillings, Heinsberg (DE)

(73) Assignee: Dimension-Polyant GmbH, Kempen (DE)

( * ) Notice: Subject to any disclaimer, the term of this patent is extended or adjusted under 35 U.S.C. 154(b) by 2445 days.

(21) Appl. No.: 12/490,946

(22) Filed: Jun. 24, 2009

(65) Prior Publication Data

US 2010/0000456 A1 Jan. 7, 2010

(30) Foreign Application Priority Data

Jun. 26, 2008 (DE) ..... 10 2008 030 446

(51) Int. Cl.

| | |
|---|---|
| ***B63H 9/06*** | (2006.01) |
| ***D06M 15/705*** | (2006.01) |
| ***D06C 15/00*** | (2006.01) |
| ***D06M 15/256*** | (2006.01) |
| ***D06M 23/08*** | (2006.01) |
| *D06M 23/16* | (2006.01) |

(52) U.S. Cl.

CPC ..... *B63H 9/0657* (2013.01); *D06C 15/00* (2013.01); *D06M 15/256* (2013.01); *D06M 15/705* (2013.01); *D06M 23/08* (2013.01); *D06M 23/16* (2013.01)

(58) Field of Classification Search

CPC ... B63H 9/0657; D06C 15/00; D06M 15/256; D06M 15/705; D06M 23/08; D06M 23/16

USPC ..... 114/102.29–102.33; 156/209, 229, 199, 156/196; 210/651; 264/283, 284, 293; 428/156, 198

See application file for complete search history.

(56) References Cited

U.S. PATENT DOCUMENTS

| | | | | |
|---|---|---|---|---|
| 4,756,835 A * | 7/1988 | Wilson | ..... | 210/651 |
| 5,304,414 A * | 4/1994 | Bainbridge et al. | ..... | 442/208 |
| 6,878,433 B2 * | 4/2005 | Curro et al. | ..... | 428/198 |

OTHER PUBLICATIONS

Alving, A. E. et al, "The effect of riblets on sails" from Experiments in Fluids, Oct. 1995, Springer-Verlag, vol. 19, Issue 6, pp. 397-404.*

* cited by examiner

*Primary Examiner* — Brian Handville
(74) *Attorney, Agent, or Firm* — Whitmyer IP Group LLC

(57) ABSTRACT

Sail membrane made of a woven fabric of synthetic fibers, with said fabric having a microroughness in the form of groove families crossing one another arranged so as to achieve a density of 5 to 25 grooves/mm deposited on or integrated into said fabric structure.

10 Claims, 3 Drawing Sheets

SAIL MEMBRANE

CROSS-REFERENCE TO RELATED APPLICATIONS

The present application claims priority of German patent application No. 10 2008 030 446.8 filed on Jun. 26, 2008.

FIELD OF THE INVENTION

The invention relates to a sail membrane made of a woven fabric of synthetic fibers, a method for manufacturing such a sail membrane and sails manufactured from said sail membrane.

BACKGROUND OF THE INVENTION

When manufacturing sails, also for competition purposes, it is an essential requirement to combine quite a number of special characteristics such as low weight, good handling qualities, low permeability to wind, high tearing resistance, elasticity, low water absorptiveness, UV resistance and similar properties. Therefore, the ultimate goal sailmakers have in mind is to create an optimized woven fabric for sail manufacturing which purposefully features all these characteristics.

In sail manufacturing processes it has not yet been attempted hitherto to integrate in a well-aimed manner structures into the surface that improve the aerodynamic properties of the material. If sail membranes are made from sheets they essentially have a smooth surface. If these membranes consist of woven fabrics which is frequently the case with high-grade and large-size sails the surface of the sails is characterized by structures that reflect the inherent woven material structures, as the case may be concealed by sheets, modified by coatings or changed by bonding or fusion means. While these fabric structures have an influence on the aerodynamic properties of the sails and, if applicable, their permeability to wind and water absorptiveness, they are unsuited, however, to purposefully change the resistance to air which is also due to their quite coarse structuring.

Resistance-causing air flow or stream separation and micro-eddying will arise on both smooth as well as structured surfaces that are facing the wind. By purposefully creating microroughness on said surfaces the resistance can be reduced. Roughness in this context is particularly microroughness that brings down the degree of turbulence in the turbulence layer in relation to the surface of the sail. Such microroughness has been developed for aircraft construction purposes where as a rule it is provided in the form of parallel grooves or flutes arranged longitudinally to the direction of the approaching air flow.

In the manufacture of sails a distinction is made between sails used for sailing close to the wind the propulsion of which is produced by the differential pressure occurring between the windward and leeward side and those sails used for sailing downwind (wind astern) the propulsion of which is for the main part brought about by the pressure exerted by the wind. Sails used for wind astern operation shall be tight to air, have a high tearing resistance and strength to withstand tear propagation and, especially in the case of spinnakers, be made of a light-weight material, feature good haptic characteristics and are easily set.

It is thus the objective of the invention to propose a sail membrane having a surface structure especially suited for sailing with wind astern, which can thus be used for the making of spinnakers and gennakers.

SUMMARY OF THE INVENTION

This objective is achieved with a sail membrane of woven synthetic fiber fabric which is provided with microroughness in the form of intersecting groove families or sets arranged so as to achieve a density of 5 to 25 grooves/mm and deposited on or integrated into said fabric structure.

According to the invention the term "sail membrane" shall be understood to relate to any woven fabric made of synthetic fibers suited for and/or employed in sailmaking. Such sail membranes are, in particular, intended for the making of sails used (also) when sailing with astern wind. The fabrics may be manufactured from fibers of a single type such as, for example, polyamide fibers, polyolefin fibers and polyester fibers but may as well comprise mixed systems. Said fabrics may be coated in a manner known per se with a view to reducing or eliminating their permeability to air and, as a rule, are hydrophobized. To bring down their permeability to air the fabrics may also be rolled and/or treated thermally, for example by fusing a fiber with a low melting point of a mixed fabric consisting of various synthetic fibers.

Especially preferred materials are polyamide (Nylon-6.6), polyester as well as polyethylene (Dyneema® and/or Spectra®).

As proposed by the invention the groove density within a groove family ranges between 5 and 25 grooves/mm corresponding to a groove crest spacing of 200 μm to 40 μm, preferably 8 to 20 grooves/mm corresponding to a crest spacing ranging between 125 μm and 50 μm.

The amplitude of the grooves, i.e. the height of the valleys between two crests up to the crest top preferably amounts to 25 to 75% of the crest spacing of a groove family and in particular 40 to 60%.

Essentially, the all the grooves of each family extend parallelly to each other and, to all intents and purposes, may be arranged on the fabric in any conceivable orientation and direction. However, preferred is a diagonal arrangement at an angle of 45° in relation to the warp or weft filaments, +/−15°. Especially preferred is an essentially diagonal arrangement at 45° because such an extension is best suited to cover up the irregularities of the fabric.

Microroughness in the form of at least two parallelly extending groove families may be integrated into the fabric structure in any desired manner, for example by printing, weaving in, applying rows of nanoparticles or by rolling-in methods. Especially preferred is the calendering method using a structuring or groove roller, with said roller being heated as a rule to a temperature which is lower than the softening temperature of the synthetic fiber or the synthetic fiber having the lowest softening point, preferably approx. 10° C. below. In the interest of improving the embossing effect it may prove expedient to treat the fabric with hot steam before it is calendered, for example at a temperature of 110° C.

Calendering takes place at elevated temperature at a pressure of at least 50 N/mm$^2$, preferably at a pressure between approx. 100 and 600 N/mm$^2$, and especially at approx. 200 to 400 N/mm$^2$.

Preferably, both sides of the sail membrane are calendered by means of such a structuring or groove roller.

Especially preferred for the inventive sail membrane is a diamond pattern consisting of grooves crossing each other, i.e. of two groove families crossing one another particularly at an angle of between 80° and 120°. In this way, a rectangular or diamond pattern is formed which is skewed by 45°+/−15° in relation to the normal fabric pattern consisting of warp and weft filaments crossing one another. However, three groove families crossing one another may also be provided, with said families intersecting at an angle of, for instance, 60° and encompassing hexagonal depressions.

The sail membrane in accordance with the invention may be hydrophobized in a manner known per se, with such a hydrophobization especially being brought about using a perfluoropolyalkylene, for example by means of Teflon®. Preferably, the hydrophobization takes place prior to the calendering process. If the fabric is dyed/colored and finished in a special manner such dyeing and finishing processes shall also take place prior to the calendering operation.

A hydrophobization may in particular be brought about, also additionally, by applying hydrophobic particles, for example by the application of nanoparticles causing a hydrophobic wetting regime according to Cassie-Baxter. Such nanoparticle coatings may be of irregular nature and particularly in terms of dimensioning should significantly fall short of the dimensioning of the groove pattern imprinted. The height of said particles should not exceed a value of 5 μm, in particular 2 μm. Such a nanoparticle coating ensures that drops of water accumulating in those locations do not wet and penetrate into the sail membrane itself but roll off the surface and thus reduce the water absorption of the membrane.

Moreover, the invention relates in particular to a process for manufacturing a sail membrane in accordance with one of the claims described hereinbefore, with the fabric in the form of gray cloth or semi-finished product being dyed and/or finished as the case may be after production and then calendered on at least one side at a pressure of at least 50 $N/mm^2$ using a structuring roll for the embossing of intersecting groove families having a density ranging between 5 and 25 grooves/mm.

In the process according to the invention the calendering operation as a rule is to be the final manufacturing step yielding the finished sail membrane product. All dyeing and finishing steps are to be carried out beforehand which also applies to hydrophobization coatings that may be applied. Calendering takes place at elevated temperature with the roll being heated up to a temperature adjusted so as to be below the softening or melting point of that synthetic fiber that has the lowest melting point. Preferably, this temperature is approx. 10° C. below the melting or softening point. With a view to improving the embossing effect the fabric may be subjected to an initial water vapor treatment, e.g. using hot steam of 110° C. A hydrophobization step as described above is also performed before the calendering operation. Further refining measures, for example the application of nanoparticle coatings aimed at improving hydrophobic characteristics, take place after calendering.

Taking the inventive sail membrane sails can be manufactured in a customary manner. Normally, the sail is assembled from individual webs or fabric segments, with the main load lines and the tearing resistance in various directions being duly taken into account in a manner known per se.

Accordingly, the invention also relates to a sail manufactured from an inventive sail membrane, especially spinnakers and gennakers.

It has been found that thanks to the intersecting groove structure provided sail membranes manufactured on the basis of the present invention have special aerodynamic properties, in particular when sailing with astern wind. Due to the calendering process the fabric's permeability to air is significantly reduced. The air permeability low as it is already may still be reduced further and even brought down to zero by taking customary coating measures for which considerably less coating material will be needed. It is advisable to carry out such a coating measure after the calendering operation.

Spinnaker and gennaker woven fabrics made in this manner as provided by the invention can be manufactured so as to be of considerably less weight. For example, if a given minimum weight is desirable or required, this saving in weight may be used to integrate reinforcing yarns so that with the overall weight being of comparable magnitude a higher tearing resistance and tear propagation strength can be achieved.

The inventive sail membranes are especially suited for the manufacture of spinnakers and gennakers. The embossed pattern of groove families crossing one another results in improved haptic characteristics which makes sail setting easier. Although for downwind sailing purposes stream separation and micro-eddying do not have a decisive influence on air resistance, the microroughness and structuring of the sail surface and the vortex separation associated with them lead to the aerodynamic properties being improved, higher sailing stability and, in particular, facilitate the setting of the spinnaker.

If the inventive sail membrane is additionally provided with a nanoparticle layer aimed at improving the membrane's water repellency its water absorptiveness can be significantly reduced in this way. In this case a continuous coating with a water-repellent agent—as well as a coating intended to reduce the permeability to wind—can be dispensed with entirely or to a large extent so that altogether a considerable reduction in weight of both a dry sail and of a sail in use at a given time is achieved.

BRIEF DESCRIPTION OF THE DRAWINGS

The invention is explained in more detail by way of the enclosed figures where.

DETAILED DESCRIPTION OF THE INVENTION

Figure 1:
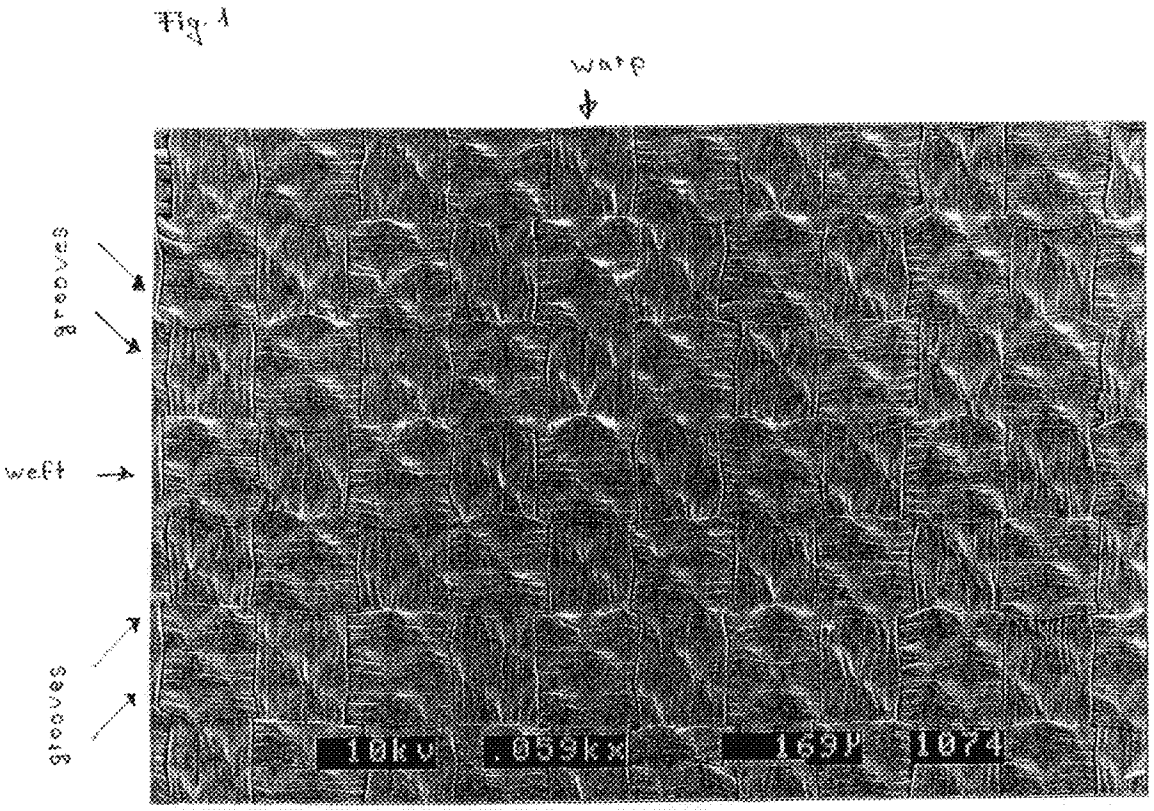
FIG. 1 shows a sailcloth fabric after calendering, 60× magnified.

In FIG. 1 a sailcloth is illustrated that consists of a woven polyamide fabric with its clearly visible warp and weft yarns extending perpendicularly to each other and being of plain weave design. By means of a calendering roll with X-corrugations an X-pattern of intersecting grooves is embossed into this fabric, said grooves running diagonally to the direction of the fabric. The individual grooves are spaced at approximately 125 μm corresponding to 8 grooves/mm. The sets of grooves running diagonally from top left to bottom right and from bottom left to top right intersect at an angle of approximately 90°. The embossing pressure was 300 $N/mm^2$, the roll temperature was adjusted to a value of 200° C.

Figure 2:
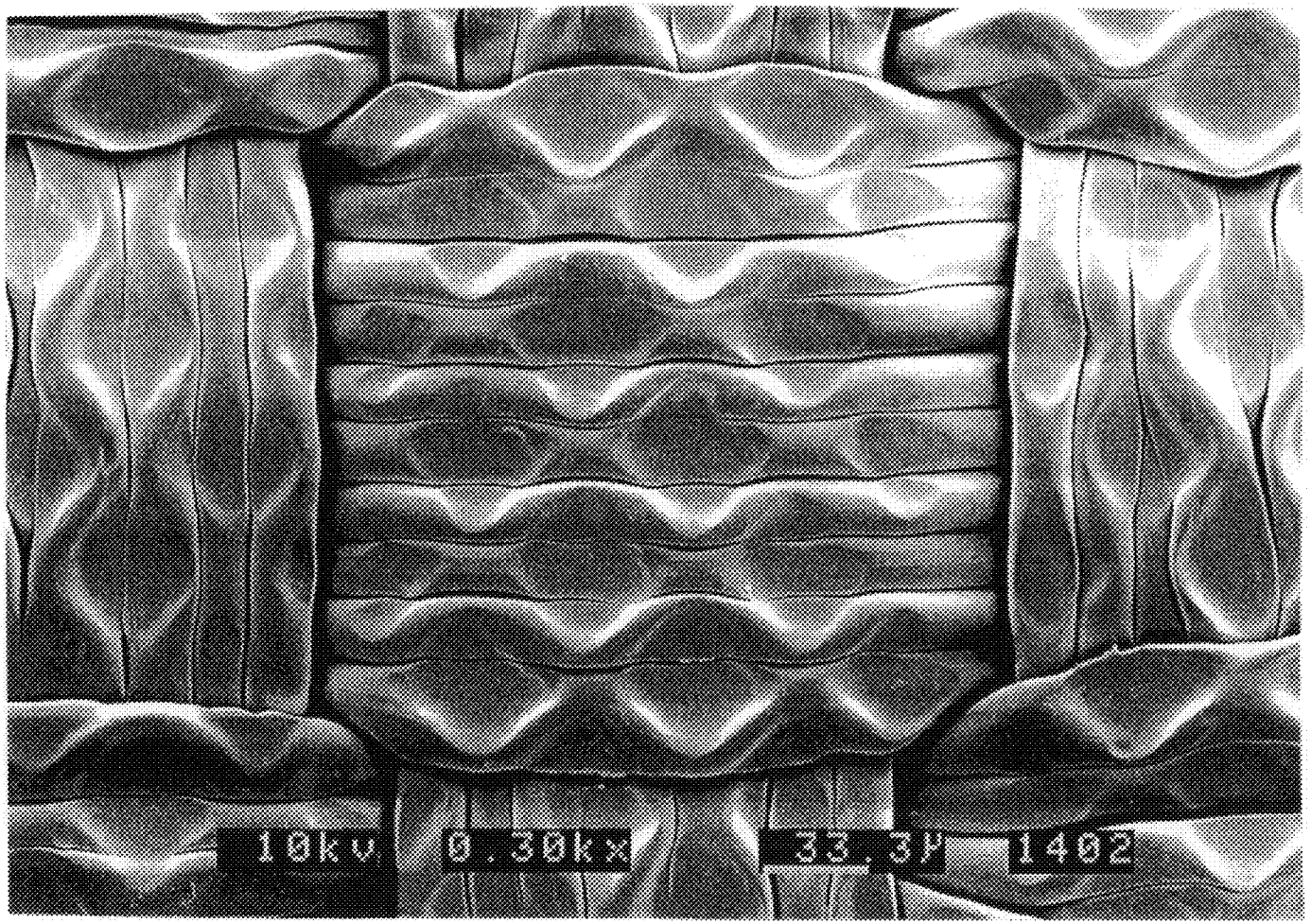
FIG. 2 shows another sailcloth fabric after calendering, 300× magnified.

FIG. 2 illustrates a sailcloth made of a polyamide fabric of plain weave design with 20 grooves/mm, magnified 300×.

Clearly visible are the crests of the intersecting grooves extending diagonally to the direction of the fibers and the enclosed diamond-shaped depressions made in the fiber surface, with said chain-like depressions continuing in fiber direction. The sailcloth was treated by means of a cross-corrugation calender at 200° C. and 300 N/mm$^2$.

Figure 3:
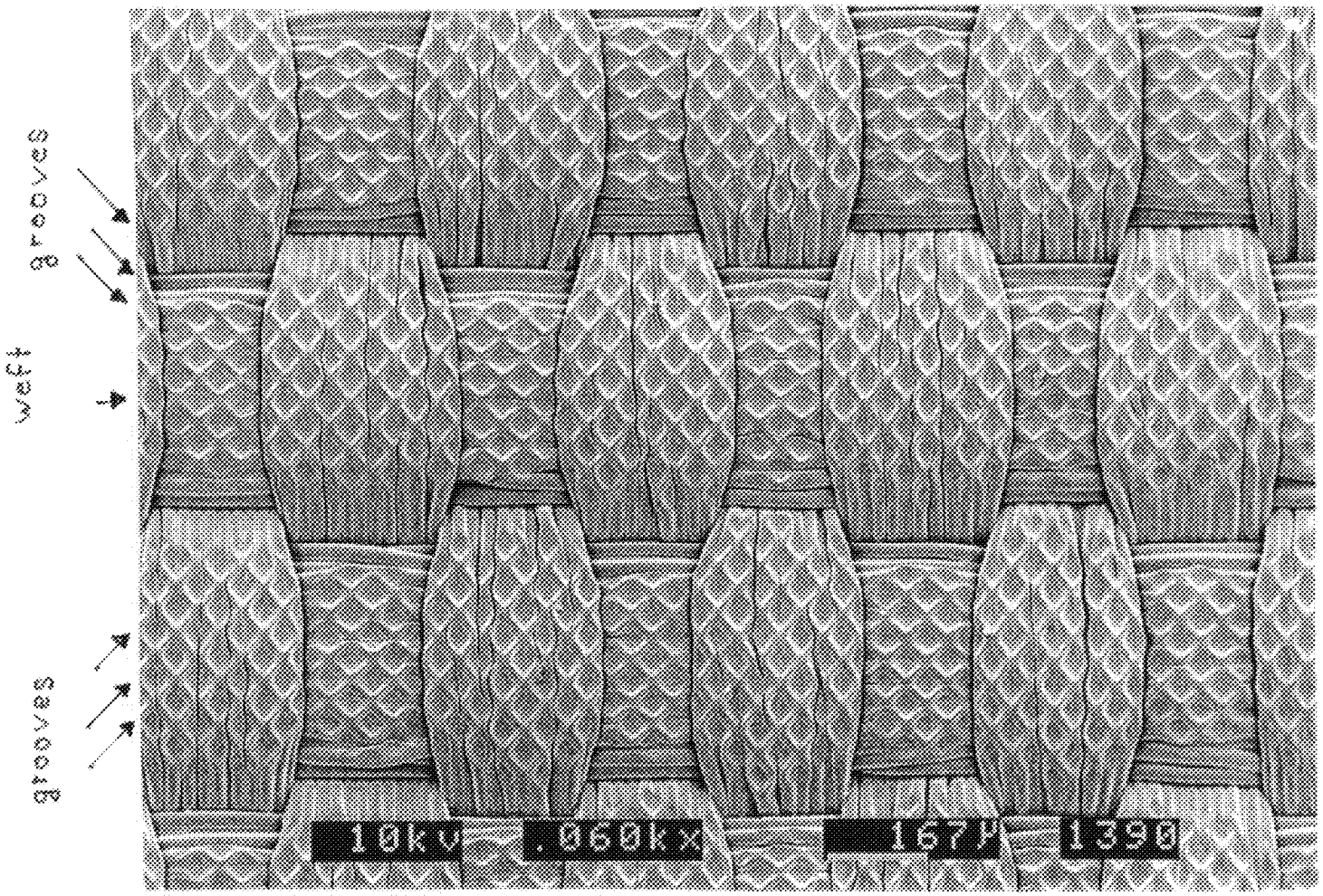
FIG. 3 shows a third sailcloth fabric after calendering, 60× magnified.

In FIG. 3 a sailcloth is illustrated that consists of a woven polyester fabric with its clearly visible warp and weft yarns extending perpendicularly to each other and being of plain weave design. By means of a calendering roll cross-corrugations were embossed into this fabric, said corrugations running diagonally to the fiber direction. The individual grooves are spaced at 50 μm from groove to groove corresponding to a groove density of 20 grooves/mm. The families or sets of grooves running diagonally from top left to bottom right and from bottom left to top right intersect at an angle of approximately 95°. The embossing pressure was 400 N/mm$^2$ at a roll temperature of 200° C.

Examinations carried out on a raw polyamide woven fabric processed by means of a corrugated roll with 8 lines/mm at a temperature of 200° C. have shown that after calendering the permeability to air at 20 mm WC of 600 to 800 l/dm$^2$/min was significantly reduced to 30 to 40 l/dm$^2$/min for the gray cloth. Further reduction is to be expected for the dyed cloth. In case of the coated sailcloth the permeability to air goes down to zero, with the coating amount being considerably lower for the calendered cloth. A lower amount of coating enables the weight of the finished sail to be reduced and such a saving in weight can be utilized to apply reinforcing measures (reinforcing yarns).

With a view to achieving optimum results the treatment by means of the corrugated roll must always be performed on both sides.

Examination series carried out on a polyamide gray cloth processed by means of a cross-corrugation roll with 20 lines/mm at a temperature of 200° C. have shown a significant interdependency between air permeability and pressure, with an optimum at 200 to 400 N/mm$^2$:

| Pressure N/mm$^2$ | Permeability to air, l/dm$^2$/min |
|---|---|
| 100 | 100 |
| 150 | 70 |
| 200 | 40 |
| 300 | 30 |
| 400 | 30 |

The gray cloth had been calendered on both sides. With dyed cloth the permeability (at 300 to 400 N/mm$^2$) was found to be 10 to 20 l/dm$^2$.

For the purpose of determining the resistance to air sail membrane samples were tested in a wind tunnel using an MAV scales test piece (6-component strain gauge MAV scales) at a windspeed of 18 m/s. The MAV scales test piece was a trapezoidal wing of small extension having a symmetrical profile. The leading edge sweep was 36°, the rear edge was straight. The wing area was covered with the cloth patterns in such a manner that the covering embraced the top side of the wing completely while just abt. a quarter of the bottom side was covered.

For a non-corrugated sail membrane the measuring results showed a coefficient of drag value $C_{Wa}$ of $7.08\times10^{-3}$ on average, for a membrane with intersecting corrugations comprising 10 grooves/mm a value of $6.54\times10^{-3}$ and with 20 grooves/mm a value of $6.4\times10^{-3}$. These are mean values determined from 500 measurements on eight measuring points.

The sail membrane samples were made of a polyester/polyethylene mixed woven fabric.

The invention claimed is:

1. A sail membrane made of a woven fabric of synthetic fibers, characterized in that said fabric has a microroughness in the form of intersecting groove families arranged so as to achieve a density of 5 to 25 grooves/mm and deposited on or integrated into said fabric surface;

wherein the grooves are generated by calendering both sides of the sail membrane.

2. The sail membrane according to claim 1, characterized in that the grooves, measured from valley bottom to top of crest, have a height amounting to 25 to 75% of the groove spacing from crest to crest.

3. The sail membrane according to claim 1, characterized in that said membrane has 8 to 20 grooves/mm.

4. The sail membrane according to claim 1, characterized in that the grooves are arranged at an angle of 30 to 60° in relation to the extension of the warp yarns.

5. The sail membrane according to claim 1, characterized in that the intersecting groove families have an intersection angle of between 80° and 120°.

6. The sail membrane according to claim 1, characterized by hydrophobization.

7. A sail manufactured from the sail membrane of claim 1.

8. The sail membrane according to claim 1, characterized in that the grooves, measured from valley bottom to top of crest, have a height amounting to 40 to 60% of the groove spacing from crest to crest.

9. The sail membrane according to claim 1, characterized in that the grooves are arranged at an angle of approximately 45° in relation to the extension of the warp yarns.

10. The sail membrane according to claim 1, characterized by hydrophobization achieved by means of perfluoropolyalkylene and/or a nanoparticle coating.

* * * * *